US005207490A

United States Patent [19]

Kaspar et al.

[11] Patent Number: 5,207,490

[45] Date of Patent: May 4, 1993

[54] SAFETY LATCH FOR THE LID OF A LIFT-TOP CABINET

[75] Inventors: Melvin C. Kaspar, LaGrange Park, Ill.; David Robinson, Valparaiso, Ind.

[73] Assignee: Ardco, Inc., Chicago, Ill.

[21] Appl. No.: 746,322

[22] Filed: Aug. 16, 1991

[51] Int. Cl.[5] ..... A47F 3/04; E05F 3/22

[52] U.S. Cl. ..... 312/139; 312/405; 16/DIG. 17

[58] Field of Search ..... 312/328, 314, 116, 138.1, 312/139.1, 139, 405; 16/66, 84, DIG. 17; 292/38

[56] References Cited

U.S. PATENT DOCUMENTS 4,813,100 3/1989 King ..... 16/DIG. 17

4,842,349 6/1989 Stenemann ..... 312/116

*Primary Examiner*—Peter R. Brown

*Attorney, Agent, or Firm*—Leydig, Voit & Mayer

[57] ABSTRACT

A gas spring is connected between a cabinet and a lift-top lid and releasably holds the lid upwardly in a fully open position with respect to the cabinet. Gravity automatically pivots a safety latch into latching relation with the cylinder of the gas spring as the lid approaches its fully open position. If the gas spring loses pressure, the latch operably engages the cylinder to mechanically hold the lid in its fully open position and to prevent the lid from falling toward its closed position.

12 Claims, 1 Drawing Sheet

SAFETY LATCH FOR THE LID OF A LIFT-TOP CABINET

BACKGROUND OF THE INVENTION

The present invention relates generally to a lift-top refrigerator cabinet and, more particularly, to a safety latch for preventing accidental lowering of the lift-top from its open position.

Certain types of refrigerated display cabinets include lift-top glass lids which are movable between a lowered closed position and a raised open position to permit access to the interior of the cabinet. Such a lid is manually lifted from the closed position to the open position, and to maintain the lid in the open position, gas springs commonly are supported at opposite ends of the lid for holding the lid in a fully open condition. Such a spring is typically charged with nitrogen gas or the like for maintaining the spring in an active or extended position. The gas charge is sufficient to maintain the glass lid in a fully open position but can be overcome by manually lowering the lid against the force of the gas pressure. After a period of time, and particularly in cold conditions associated with refrigerators, the gas springs can lose pressure, either partially or completely. In the event of a partial loss of pressure, the springs may allow the lid to lower partially, resulting in the lowered outwardly extended end of the lid creating a safety hazard to personnel moving about the cabinet. In the event of a complete loss of pressure, the unexpected collapse of the lid can cause injury to personnel placing items into or removing items from the cabinet.

SUMMARY OF THE INVENTION

The general aim of the present invention is to provide a safety device for preventing closure of a lift-top lid of a refrigerated cabinet in the event of failure of or loss of pressure in gas springs supporting the lid in an open position.

Another object of the invention is to provide a safety device as characterized above that is automatically actuated upon raising of the lid to a fully open position, so as to be fail-safe in operation.

A further object is to provide a lift-top safety device of the above kind that requires manual deactuation in order to permit return of the lid from a fully open position to a closed position.

Still another object is to provide a safety device of the foregoing type which is easily deactuatable by a single person tending the cabinet.

Yet another object is to provide a lift-top refrigerator cabinet safety device of such type which is relatively simple in construction and operation and which lends itself to economical manufacture.

These and other objects and advantages of the invention will become more apparent from the following detailed description when taken in conjunction with the accompanying drawings.

DETAILED DESCRIPTION OF THE PREFERRED EMBODIMENT

Figure 1:
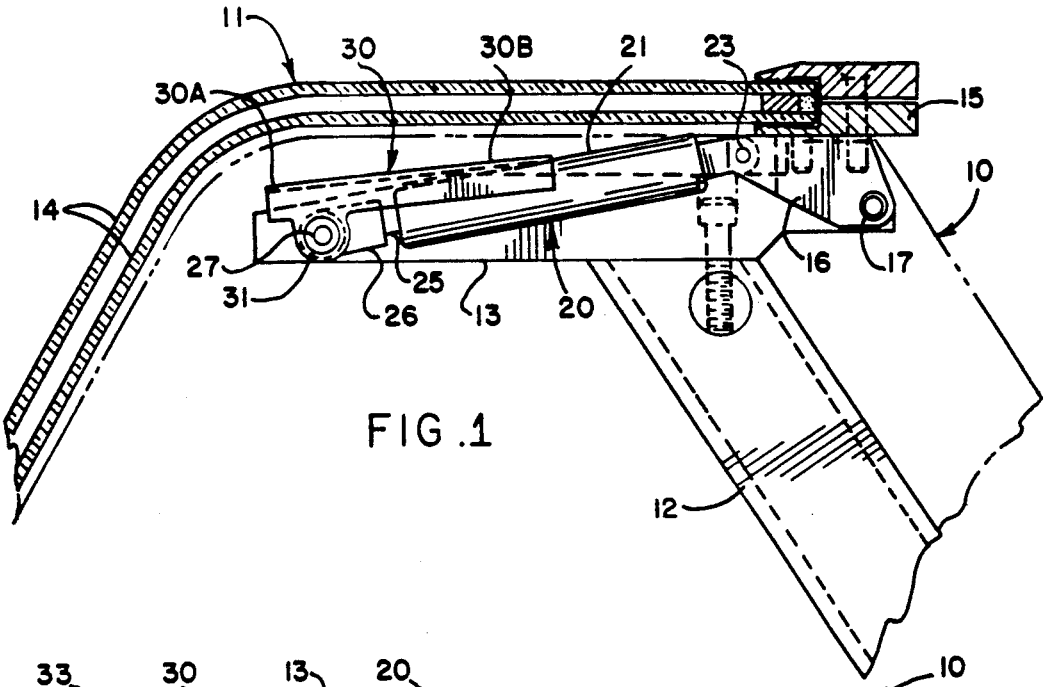
FIG. 1 is a fragmentary cross-sectional view of a lift-top cabinet equipped with a new and improved safety device incorporating the unique features of the present invention, the lid of the cabinet being shown in its fully closed position.
Figure 2:
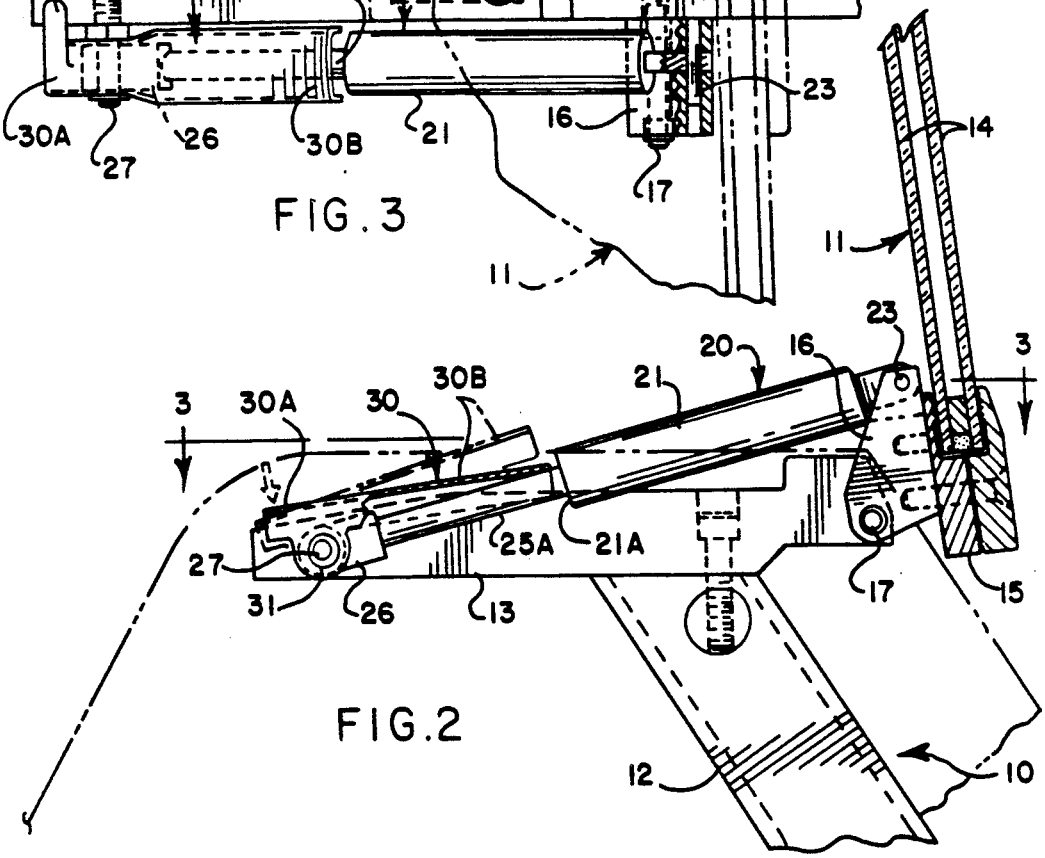
FIG. 2 is a view similar to FIG. 1 but shows the lid in its fully open position.

For purposes of illustration, the invention has been shown in the drawings in conjunction with a lift-top refrigerated display cabinet 10 having a glass lid 11 which is hinged to the cabinet to swing upwardly from a fully closed position shown in FIG. 1 to a fully open position shown in FIG. 2. The cabinet may, for example, be used in supermarkets and other grocery outlets to hold and display cold or frozen food items.

The cabinet 10 and the lid 11 have been shown only to the extent necessary to gain an understanding of the present invention. One end of the cabinet includes a generally upright rear frame member 12 which supports a generally horizontal and forwardly extending mounting bracket 13. The lid comprises two spaced panes 14 of curved glass connected to a rear frame member 15. Secured to one end of the frame member 15 is a hinge block 16 which is pivotally connected at 17 to the rear of the bracket 13. Thus, the block 16 and the pivot 17 support the lid to swing upwardly and downwardly on the cabinet 10 about a generally horizontal axis.

To hold the lid 11 in its fully open position (FIG. 2), a gas spring 20 of conventional construction is connected between the cabinet 10 and the lid. Herein, the gas spring includes a cylinder member 21 having a rear end connected pivotally at 23 to the block 16 to pivot relative to the block about an axis paralleling the hinge axis 17. Slidably received in the cylinder 21 is an elongated rod member 25 whose forward end carries a block 26 which is pivotally connected to the mounting bracket 13 by a horizontal pivot bolt 27. Thus, the gas spring 20 may pivot relative to the bracket 13 and the block 16 as necessary to permit opening and closing of the lid 11.

When the lid 11 is fully closed, the cylinder 21 is fully retracted relative to the rod 25 and receives a substantial length of the rod as shown in FIG. 1. As the lid is opened, the cylinder slides rearwardly along the rod and extends to the position shown in FIG. 2. To assist in lifting the heavy lid and to prevent the lid from banging shut, the rear end portion of the cylinder is charged with gas such as nitrogen which tends to cause the cylinder to extend relative to the rod. When the lid is in its fully open position shown in FIG. 2, the pressure of the gas causes the cylinder to hold the lid open. By pushing the lid downwardly, the pressure may be overcome to permit controlled closing of the lid.

It should be understood that the other end of the lid 11 is also hinged to the cabinet 10 in the manner shown in FIG. 1. Also, a gas spring similar to the gas spring 20 preferably is located at the other end of the door.

After the gas spring 20 has been in use over a period of time, it may partially or completely lose gas pressure. The danger of pressure loss is particularly acute where, as in the present case, the gas spring is in a cold environment. If the spring completely fails, there is a risk of the lid 11 slamming shut and injuring a person placing items into or removing items from the cabinet. If the spring only partially fails and the lid moves to a partially closed position, there is a danger that a passerby could walk into and become injured by the lid.

In accordance with the present invention, the cabinet 10 is equipped with a mechanical safety device 30, which when the lid 11 approaches its fully open position, automatically moves into a latching position and prevents the lid from closing in the event the gas spring 20 fails. When it is desired to move the lid from its fully open position, only a simple manual operation is required to release the safety device.

Figure 3:
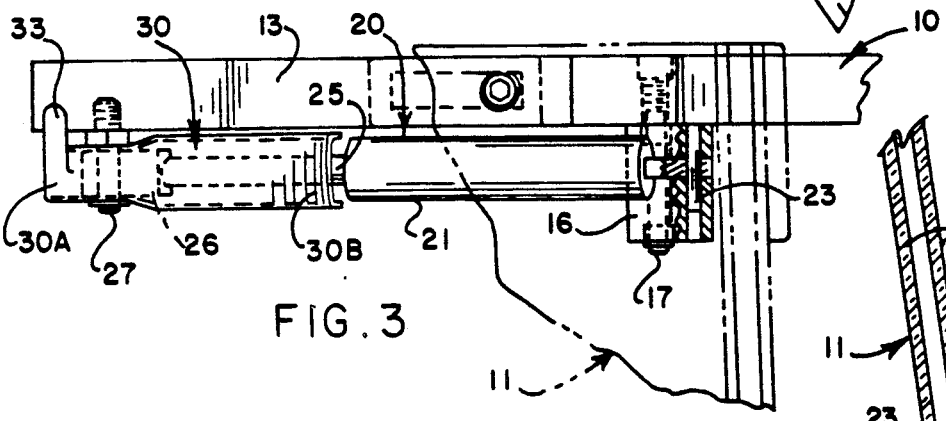
FIG. 3 is a top plan view of the structure illustrated in FIG. 2, certain parts being broken away and shown in section.

Herein, the safety device 30 is a one-piece latch which preferably is stamped and formed from sheet metal. The forward end portion of the latch 30 is formed with a pair of downwardly projecting ears 31 which straddle the block 26 on the rod 25. The pivot bolt 27 extends through holes in the ears and supports the latch to pivot upwardly and downwardly about the pivot axis of the block. The main portion of the latch 30 (i.e., the portion located above the mounting ears) is shaped generally as an inverted U (see FIG. 3) and is disposed above the gas spring 20. The latch includes a short forward section 30A extending forwardly from the pivot axis 27 of the latch and further includes a significantly longer nose section 30B which extends rearwardly from the pivot axis. Because of the greater weight of the nose section 30B, gravity biases the latch clockwise about the pivot axis 27 and thus biases the nose section in a downward direction.

When the lid 11 is fully closed, the nose section 30B of the latch 30 rests in an inactive position on the forward end portion of the cylinder 21 as shown in FIG. 1. If the lid is only partially opened and then closed—as is usually the case when a consumer removes an item from the display cabinet 10—the cylinder simply slides idly back and forth along the latch, and the latter remains in its inactive position without interfering with opening and closing of the lid. If, however, the lid is fully opened to the position shown in FIG. 2, the forward end 21A of the cylinder moves rearwardly past the rear end of the nose section 30B of the latch 30. As an incident thereto, the latch pivots clockwise to allow the nose section to drop downwardly onto the rod 25 and into latching relation with the forward end 21A of the cylinder (see FIG. 2). As a result, the latch 30 prevents the cylinder 20 from retracting relative to the rod 25 and mechanically hold the lid 11 in its fully open position in the event the gas spring 20 loses pressure or otherwise fails.

The lid 11 usually is raised to its fully open position only by a person stocking or rearranging merchandise in the cabinet 10. When that person wishes to close the lid, all that is necessary is to manually push downwardly on a laterally extending finger 33 (FIG. 3) integral with the short forward section 30A of the latch 30 in order to pivot the latch counterclockwise out of latching engagement with the forward end 21A of the cylinder 21. The lid then may be swung closed in the normal manner. For convenience, a safety latch 30 is associated only with the gas spring 20 on one end of the lid and thus a person standing near one end of the cabinet 10 may easily release the latch to permit closing of the lid.

From the foregoing, it will be apparent that the present invention brings to the art a new and improved safety latch 30 which coacts directly with the gas spring 20 of the glass lid 11 of a lift-top cabinet 10 to insure that the lid will not drop from its fully open position and cause injury or damage in the event the gas spring loses pressure. The latch is fail-safe in that it sets automatically each time the lid is moved to its fully open position and thus the safety afforded by the latch is not dependent upon a person intentionally placing the latch in an operative position. Moreover, the latch does not set during partial opening of the lid and thus usually does not interfere with normal operation of the lid by a consumer. The latch is easy to release and its one-piece construction makes it very economical to manufacture.

We claim:

1. A cabinet having a top lid hinged thereto to swing upwardly to a fully open position and downwardly to a fully closed position, a gas spring connected between said cabinet and said lid and normally operable to releasably hold said lid upwardly in said fully open position, said gas spring comprising a cylinder member and a rod member slidable within said cylinder member, said members extending relative to one another during movement of said lid toward said open position and retracting relative to one another during movement of said lid toward said closed position, said cylinder member containing fluid which is pressurized during retraction of said members relative to one another thereby to resist movement of said lid toward said closed position, a latch, means supporting said latch for pivotal movement about a horizontal axis, said latch having an engagement and resting idly on one of said members when said lid is in said closed position, said engagement end having an inverted U-shaped cross section with depending legs of said engagement end being spaced a distance greater than the width of said one member such that no portion of said engagement end extends under said one member in a manner that would restrict free upward movement of said engagement end relative to said one member upon pivoting of said latch, said latch engagement end being downwardly moveable under the force of gravity into latching relation with said one member as said members extend relative to one another as said lid approaches said fully open position to prevent retraction of said members relative to each other to thereby positively hold said lid upwardly, and said latch being freely pivotable about said horizontal axis for raising said engagement end upwardly relative to said one member to permit retraction of said members and downward movement of said lid to said closed position.

2. A cabinet as defined in claim 1 in which said latch is connected to said cabinet for pivotal movement about a horizontal axis.

3. A cabinet as defined in clam 2 in which the other of said members is connected to said cabinet to pivot upwardly and downwardly about said horizontal axis.

4. A cabinet as defined in claim 1 in which said latch is pivotally mounted on an end of said rod and said engaging end rides on said cylinder.

5. A cabinet as defined in claim 1 in which said latch is pivotally mounted on said cabinet at an end of said rod and said engagement end rides on said cylinder.

6. A cabinet having a top hinged thereto to swing upwardly to a fully open position and downwardly to a fully closed position, a gas spring connected between said cabinet and said lid and normally operable to hold said lid upwardly in said fully open position, said gas spring comprising a rod connected to said cabinet to pivot about a first horizontal axis and a cylinder slidable relative to said rod and connected to said lid to pivot about a second horizontal axis, said cylinder extending relative to said rod during movement of said lid toward said open position and retracting relative to said rod during movement of said lid toward said closed position, said cylinder containing fluid which is pressurized during retraction of said cylinder relative to said rod thereby to resist movement of said lid toward said closed position, a latch connected to said cabinet to pivot about said first axis, said latch having an engagement end resting idly on said cylinder when said lid is in said closed position said engagement end having an inverted U-shaped cross section with depending legs of said engagement end being spaced a distance greater than the width of said cylinder such that no portion of said engagement end extends under said cylinder in a manner that would prevent free upward movement of said engagement end relative to said cylinder and rod upon pivoting of said latch, said latch engagement end being moveable downwardly under the force of gravity into latching relation with one end of said cylinder as said cylinder extends relative to said rod and as said lid approaches said fully open position to thereby positively hold said lid upwardly, and said latch being freely pivotable about said horizontal axis for raising said engagement end upwardly relative to said cylinder and rod to permit retraction of said cylinder relative to said rod and downward movement of said lid to said closed position.

7. A cabinet as defined in claim 6 in which the center of gravity of said latch is located relative to said first axis such that said latch is biased by gravity to swing downwardly about said first axis.

8. A cabinet as defined in claim 6 in which said latch is shaped so as to straddle and rest on said cylinder when said lid is in said fully closed position and to straddle and rest on said rod when said lid is in said fully open position.

9. A cabinet having a top lid hinged thereto to swing upwardly to a fully open position and downwardly to a fully closed position, a gas spring connected between said cabinet and said lid and normally operable to releasably hold said lid upwardly in said fully open position, said gas spring comprising a cylinder member and a rod member slidable within said cylinder member, said members extending relative to one another during movement of said lid toward said open position and retracting relative to one another during movement f said lid toward said closed position, said cylinder member containing fluid which is pressurized during retraction of said members relative to one another thereby to resist movement of said lid toward said closed position, a latch, means supporting said latch for pivotal movement about a horizontal axis, said latch having an engagement portion at one end extending rearwardly of said pivot axis and resting idly on one of said members when said lid is in said closed position and pivoting downwardly under the force of gravity into latching relation with said one member as said members extend relative to one another as said lid approaches said fully open position to prevent retraction of said members relative to one another to thereby positively hold said lid upwardly, and said latch having a finger portion on an end of said latch opposite said finger portion, said finger portion being disposed forwardly of said horizontal axis and extending laterally to one side of said latch for manual engagement for pivoting said latch about said horizontal axis to release said latch engagement portion from latching relation with said one member.

10. A cabinet as defined in claim 9 in which said latch has an inverted U-shaped cross-section.

11. A cabinet having a top lid hinged thereto to swing upwardly to a fully open position and downwardly to a fully closed position, a gas spring connected between said cabinet and said lid and normally operable to releasably hold said lid upwardly in said fully open position, said gas spring comprising a rod connected to said cabinet to pivot about a first horizontal axis and a cylinder slidable relative to said rod and connected to said lid to pivot about a second horizontal axis, said cylinder extending relative to said rod during movement of said lid toward said open position and retracting relative to said rod during movement of said lid toward said closed position, said cylinder member containing fluid which is pressurized during retraction of said cylinder relative to said rod thereby to resist movement of said lid toward said closed position, a latch connected to said cabinet to pivot about said first axis, said latch having an engagement portion at one end extending rearwardly of said first axis and resting idly on said cylinder when said lid is in said closed position and pivoting downwardly into latching relation with said cylinder as said cylinder extends relative to said rod as said lid approaches said fully open position, and said latch having a finger portion on an end of said latch opposite said finger portion, said finger portion being disposed forwardly of said first horizontal axis and extending laterally to one side of said latch for manual engagement for pivoting said latch about said first axis to release said latch engagement portion from latching relation with said one member.

12. A cabinet as defined in claim 11 in which said latch has an inverted U-shaped cross-section.

* * * * *